US009747749B1

(12) United States Patent
Wisler et al.

(10) Patent No.: US 9,747,749 B1
(45) Date of Patent: Aug. 29, 2017

(54) MULTI-WAGER CASINO GAMES WITH TOKEN DETECTION

(71) Applicant: Masque Publishing, Inc., Lone Tree, CO (US)

(72) Inventors: James M. Wisler, Lone Tree, CO (US); Anthony G. Andersen, Aurora, CO (US); John C. Ridges, Highlands Ranch, CO (US); Werner W. Willemse, Poway, CA (US); Waldemar A. Willemse, Poway, CA (US)

(73) Assignee: Masque Publishing, Inc., Lone Tree, CO (US)

( * ) Notice: Subject to any disclaimer, the term of this patent is extended or adjusted under 35 U.S.C. 154(b) by 407 days.

(21) Appl. No.: 14/466,062

(22) Filed: Aug. 22, 2014

Related U.S. Application Data

(60) Provisional application No. 61/871,660, filed on Aug. 29, 2013.

(51) Int. Cl.
*G07F 17/32* (2006.01)

(52) U.S. Cl.
CPC ..... *G07F 17/3248* (2013.01); *G07F 17/3258* (2013.01); *G07F 17/3293* (2013.01)

(58) Field of Classification Search
CPC ..... G07F 17/3248; G07F 17/3258; G07F 17/3293
See application file for complete search history.

(56) References Cited

U.S. PATENT DOCUMENTS

| | | | | |
|---|---|---|---|---|
| 4,051,365 | A * | 9/1977 | Fukuyama | G01S 7/4811 250/222.1 |
| 4,836,553 | A | 6/1989 | Suttle et al. | |
| 4,861,041 | A | 8/1989 | Jones et al. | |
| 5,078,405 | A | 1/1992 | Jones et al. | |
| 5,288,077 | A | 2/1994 | Jones | |
| 5,393,067 | A * | 2/1995 | Paulsen | G07F 17/32 194/239 |
| 5,472,194 | A | 12/1995 | Breeding et al. | |
| 5,577,731 | A | 11/1996 | Jones | |
| 5,626,341 | A | 5/1997 | Jones et al. | |
| 5,795,225 | A | 8/1998 | Jones et al. | |
| 6,299,534 | B1 | 10/2001 | Breeding et al. | |
| 7,367,884 | B2 | 5/2008 | Breeding et al. | |
| 9,536,389 | B2 * | 1/2017 | Helgesen | G07F 17/3251 |
| 2002/0033884 | A1 * | 3/2002 | Schurr | G01C 11/00 348/127 |
| 2004/0009799 | A1 * | 1/2004 | Breeding | A63F 3/00157 463/11 |

(Continued)

*Primary Examiner* — Corbett B Coburn
(74) *Attorney, Agent, or Firm* — Sheridan Ross P.C.

(57) ABSTRACT

A system having a plurality of interconnected controls is provided for playing multiple-wager casino card games using gaming tables found at one or more casinos. Both physical and electronic cards can be utilized, depending on game play outcomes. Information related to game play can be sent by one or more table controls to a central control through one or more casino controls for use in generating additional information. A token detection apparatus, which includes a particular one of the table controls, provides un-modulated light for use in detecting whether or not a token is present as part of game play. The token is used in making a progressive/fixed amount wager.

4 Claims, 8 Drawing Sheets

(56) References Cited

U.S. PATENT DOCUMENTS

| | | | | |
|---|---|---|---|---|
| 2007/0149278 | A1 | 6/2007 | Walker et al. | |
| 2008/0116631 | A1* | 5/2008 | Shoemaker | G07F 17/3297 273/138.3 |
| 2008/0169301 | A1* | 7/2008 | Mok | A47K 10/36 221/9 |
| 2009/0115133 | A1* | 5/2009 | Kelly | A63F 3/00643 273/274 |
| 2009/0267919 | A1* | 10/2009 | Chao | G06F 3/0421 345/175 |
| 2011/0306416 | A1* | 12/2011 | Kelly | G07F 17/32 463/31 |
| 2012/0094750 | A1* | 4/2012 | Kuo | G07D 5/00 463/29 |
| 2012/0122559 | A1* | 5/2012 | Kelly | G07F 17/322 463/25 |
| 2014/0292306 | A1* | 10/2014 | Prance | G01V 3/088 324/123 R |
| 2014/0295948 | A1* | 10/2014 | Helgesen | G07F 17/3251 463/25 |
| 2016/0184694 | A1* | 6/2016 | Hwang | G07F 17/32 273/292 |
| 2016/0220891 | A1* | 8/2016 | Hwang | A63F 1/00 |

* cited by examiner

MULTI-WAGER CASINO GAMES WITH TOKEN DETECTION

CROSS REFERENCE TO RELATED APPLICATION

This application claims the benefits of, including priority to, U.S. Provisional Application Ser. No. 61/871,660, filed Aug. 29, 2013 entitled "Multi-Wager Casino Games With Token Detection", the entire contents of which is incorporated herein by this reference.

FIELD OF THE INVENTION

The present invention relates to casino table games in which a plurality of wagers can be made during each round of play and, in particular, to playing blackjack variant card games involving progressive and/or fixed amount related payouts, including wagers made with gaming tokens that are detected using un-modulated light technology.

BACKGROUND OF THE INVENTION

Casino table games, particularly casino card games that include progressive wagers, have proven to be highly popular among players. The progressive wager is a side bet that does not essentially affect the play of the base or underlying game, such as Twenty-One (Blackjack) or variants thereof. The progressive wager is one in which at least some of the amounts waged by players can be applied to a progressive jackpot. The amount in the progressive jackpot, and the amount that can be won, can increase over rounds of play. It is also common practice to have the progressive jackpot depend on play from multiple tables located in a single casino, which can be extended to multiple tables located in more than one casino. Large numbers of tables associated with a common progressive jackpot can substantially affect the amount in the progressive jackpot.

Many patents have issued over the years describing different games that include progressive wagers. These include a number of table game patents that include progressive wagers, such as: U.S. Pat. Nos. 4,836,553; 4,861,041; 5,078,405; 5,288,077; 5,472,194; 5,626,341; 5,795,225; 6,299,534; and 7,367,884. Some of these patents also describe specific means and methods for determining whether a progressive wager was placed using a gaming token or chip. U.S. Pat. No. 5,078,405 issued Jan. 7, 1992 to Jones et al. discloses the use of a coin acceptor or slot into which a gaming token is inserted when a progressive bet is made. Control circuitry senses the inserted token and functions with other electronic elements to control a progressive jackpot meter. U.S. Pat. No. 5,472,194 issued Dec. 5, 1995 to Breeding et al. describes the use of pressure switches that are activated by the players in conjunction with making progressive wagers. U.S. Pat. No. 6,299,534 issued Oct. 9, 2001 to Breeding et al. discloses a non-photoelectric proximity sensor that is used in detecting a gaming token when it is used to make a progressive wager. These non-photoelectric sensors include inductive, capacitive and/or ultrasonic sensors. U.S. Pat. No. 7,367,884 issued May 6, 2008 to Breeding et al. discusses a photoelectric sensor that provides modulated light in connection with detecting whether a gaming token is present that is indicative of a progressive wager being made. In connection with another embodiment, this patent describes a photoelectric sensor that senses ambient light. A gaming token that is present essentially blocks ambient light. This causes the photoelectric sensor to turn off, thereby indicating that a token is present.

Many systems and methods have been devised for use in playing casino games having a progressive jackpot. Based on the popularity of these games, opportunities exist to identify and develop novel concepts that further appeal to the large numbers of players who play casino games with progressive features. Numerous technologies have also been used or advanced related to determining whether a progressive wager was made as part of playing a casino table game. It would be additionally beneficial to provide an innovative design for sensing a gaming token used to make a wager involving a progressive and/or fixed amount related payout, and then use that detected information to properly control results of such a wager.

SUMMARY OF THE INVENTION

In accordance with the present invention, a system for enabling multiple wagers to be made while playing card games on tables at one or more casinos is provided. The card games can include Blackjack/Twenty-One and variants thereof, such as "Spanish 21", as well as game options or features which are playable with twenty-one card games, namely the game or feature identified as "Match The Dealer." The system includes a central control that is preferably housed in a facility different from each of the one or more casinos. The central control is connectable to one or more casino controls using the Internet. One or more embodiments having a single casino control in the system has the single casino control designated as a master casino control. One or more embodiments having a plurality of casino controls in the system has one of them designated as a master casino control. In one embodiment, each casino control is located in or at its associated casino having the tables at which the card games are played. In another embodiment, one or more casino controls are located remotely from the casino with which they are associated. Typically, there is one casino control associated with each casino, and each casino can have a plurality of gaming tables on which the table games of the system are played. Each of the plurality of gaming tables can include a table control, which is part of a token detection apparatus. The token detection apparatus, using its table control, ascertains whether or not a token or chip, which is used to make a progressive/fixed amount wager while playing a table game, is present. Each table control can communicate with the casino control of its associated casino.

A primary function of the central control relates to providing random numbers to each of the casino controls. The random numbers are used by the casino controls in determining or interpreting electronic cards to be sent to their associated table controls. Electronic cards are provided to one or more table controls when a player satisfies certain card game requirements in which physical cards are utilized, including a progressive/fixed amount wager being made by that player. If the electronic cards match one of a number of possible winning sets of cards, the player can win a substantial amount of money, with some payouts being in the millions of dollars.

A primary function of each casino control relates to receiving, from its associated table control(s) game play information. Such information is provided to each casino control by the table controls to which each casino control is connected. This game play information can include for each casino: the number of tables, together with their identifiers, used in playing the table games of the system; and the number of wagers made at each table. The game play information an be sent by the designated master casino control to the central control. For embodiments in which there are multiple casino controls, the designated master casino control can provide combined game play information to the central control, after obtaining such information from the other casino controls. At least portions of the game play information can be used by the central control in determining the identities of the tables of the system that were used in playing games of the system for a pre-established time period, such as a particular month. The central control is preferably owned by, or under the legal control of, a third party who is not the owner of, or the controlling entity for, any of the one or more casinos using the system. In such a case, the third party typically has authorization to receive the game play information. The third party could use the information received by the central control in connection with billing one or more casino owners for use of the system.

Regarding each token detection apparatus provided at each gaming table, tokens or chips used in making progressive/fixed amount wagers are automatically detected using a sensor assembly which includes an emitter that outputs un-modulated emitter light. When a token is present, at least some of this un-modulated emitter light returns as returned un-modulated light. The returned un-modulated light is sensed using a receiver of the sensor assembly. Sensor circuitry is operably connected to the receiver for communicating information related to the returned un-modulated light to the table control. The sensor circuitry includes sensor housing circuitry and multiplex circuitry. The table control receives such light-related information, using the multiplex circuitry, in the form of a processed light detection signal, which is used by the table control in determining whether a token is present. In that regard, when a token is present, sufficient returned un-modulated light (e.g. un-modulated light above a predetermined threshold) is detected using the receiver, sensor housing circuitry and the table control. This determination or information related to the presence of a token is useful in identifying, to the operator or dealer, a player who made any winning progressive/fixed amount wager and is useful, at a desired or predetermined time, in updating a progressive jackpot display.

In one embodiment and when activated or turned on, the emitter outputs un-modulated light in the infrared range. This un-modulated light could have a peak wavelength of 940 nm (nanometers), a power dissipation of 200 mw (milliwatts) and an emission angle of 40 degrees. The receiver could have a daylight blocking filter in which the filter bandwidth is matched with infrared emitters that output infrared light in the range of 900 nm-950 nm, which includes the 940 nm wavelength.

The sensor assembly also includes a sensor housing that contains the emitter, receiver and the sensor housing circuitry. The sensor assembly can be supported by a casino table on which the game having the progressive/fixed amount wager is played. At least major portions of the sensor assembly can be removably held just below a progressive wager area delineated or otherwise made known on the table. In one embodiment, the sensor housing has a cover and a container. The cover is joinable to the container. The container can contain the emitter, receiver and sensor housing circuitry above its base or bottom. The sensor housing also has a light path member for guiding un-modulated emitter light output from the emitter towards the progressive/fixed amount wager area so that, when a token is present in that area, such light will be guided in a path to the progressive/fixed amount wager area having the token. Similarly, the light path member can also guide un-modulated returned light returning along a path from the token to the receiver. The light path member can be formed with the cover, such as on the cover underside (that side of the cover that faces inwardly of the sensor housing). The light path member can be of any desired shape that functions to properly guide light relative to the progressive/fixed amount wager area. The light path member can be generally conical-shaped in which the tip thereof (its narrowest portions) is located more inwardly of the sensor housing than are other portions thereof.

The sensor housing circuitry can communicate with a light array comprising a number of light emitting diodes (LEDs) for use in indicating to the dealer when a token is present. That is, when a token is present, the table control determines its presence using the processed light detection signal. Subsequently, based on such information in one embodiment, the table control causes the light array to be energized or turned on by providing a command signal to the light array using portions of the sensor housing circuitry. In another embodiment, based on such information that a token is present, the table control causes the light array to remain energized or turned on. In such an embodiment, the light array is energized before the detection process is started so that an indication that a token is present is provided by the light array remaining turned on. Conversely, for a light array associated with a wager area that is detected as not having a token, its light array is turned off. The light array is preferably located adjacent to the progressive/fixed amount wager area and, more preferably, surrounds the progressive/fixed amount wager area.

The sensor housing circuitry is electrically connected to a cable, such as a ribbon cable, comprising a number of conducting wires for carrying information, including command and data signals. Such signals are carried by the ribbon cable using the multiplex circuitry that is electrically connected to each of the sensor housing circuitry provided with a particular table. The multiplex circuitry transfers such signals relative to the table control. These command and data signals are used in operating each of the sensor assemblies associated with the particular table. In one embodiment, in connecting the cable to the sensor housing circuitry, a cable plug of the sensor housing circuitry is used that can be connected to other parts or components of the sensor housing circuitry in two different ways and still obtain the same desired result. Basically, the same information can be carried by two different cable conducting wires, or pairs of wires. Such two different wires are located at diagonally opposite ends of the cable plug so that the cable plug can be electrically connected to such other parts of the sensor housing circuitry in each one of the two ways. This enables the cable connected to the cable plug to be desirably positioned or laid relative to a casino table, especially when a number of sensor assemblies are used with the same casino table. According to one preferred arrangement, when positioning the cable as part of interconnecting a number of sensor assemblies, portions of the cable are bent or folded over so that effectively the thickness of the bent cable portions is doubled and sufficient space, using a recess formed in a table or foam layer, is provided to receive or accommodate this increase in the thickness of the cable portions.

With respect to using a plurality of sensor assemblies, depending on table size, any number of such assemblies could be utilized but a typical number of sensor assemblies used on one table could be six, seven or eight. Regardless, each of the plurality of sensor assemblies is electrically interconnected using the ribbon cable. Each sensor assembly using its sensor housing circuitry and the ribbon cable, that is common to each of them, is able to bi-laterally communicate with the table control, through the multiplex circuitry, in order to send and/or receive the command and data information. Commands can be sent using identification information that corresponds to a particular sensor assembly, with each sensor assembly having its own unique identifier.

Regarding one method of system operation related to making one or more progressive/fixed amount wagers, at the start of a casino card game round of play, each player at the table decides whether to make a progressive/fixed amount wager. The progressive/fixed amount wager can be one of several wagers, including a base wager made for playing the underlying or base game, such as twenty-one, and a side bet or ancillary wager made for playing an option or feature associated with the base game, such as the "Match The Dealer" game or feature. For each player making a progressive/fixed amount wager, a token is placed by the player on the progressive/fixed amount wager area associated with that player. Once the dealer determines that any and all progressive/fixed amount wagers are made for the current round of game play, the dealer activates a progressive/fixed amount input element. This can be done by contacting such an element that can be part of a panel of the token detection apparatus for that table. The panel can be part of a unit that houses the table control. The table control is responsive to activation of this input element. That is, under the command of the table control and communicating such command using the multiplex circuitry and the ribbon cable, a light control signal is generated by each sensor housing circuitry provided with the table. Each light control signal is used in energizing or turning on a particular one emitter of one of the sensor assemblies. Each emitter outputs un-modulated emitter light. Each associated light path member assists in directing the un-modulated emitter light to its associated progressive/fixed amount wager area.

For each progressive/fixed amount wager area on which a player placed a token, un-modulated returned light occurs due to the presence of the token which sufficiently prevents or otherwise hinders un-modulated emitter light from traveling past the token; instead, at least significant portions of such light are reflected and can be defined as un-modulated returned light. Like the emitter light, at least some of the returned light is guided by the light path member towards each receiver of each sensor assembly associated with a table position at which the progressive/fixed amount wager area has a token. At least some of the returned light is input to each associated receiver. A processed light detection signal is subsequently generated using each applicable sensor housing circuitry and input to the table control using the cable and the multiplex circuitry. The table control determines which of the progressive/fixed amount wager areas of the table has a token using the processed light detection signals obtained using the outputs from the receivers of the sensor assemblies provided with the table. Based on such determinations, the table control can initiate the providing of any and each indication of which progressive/fixed amount wager area has a token. Any such indication is provided by turning on or energizing each light array using components of each sensor housing circuitry that is associated with a sensor assembly that senses a token being currently present. An activated or lit light array adjacent to a particular progressive/fixed amount wager area indicates to any observer (e.g. dealer, players) that a progressive/fixed amount wager has been made at that location. In one embodiment, after each lit light array indicates the presence of any token that is present, the dealer can remove any one or more tokens that are present and any associated light array remains lit. In one embodiment as well, each emitter can automatically turn off after a predetermined or convenient time using the table control.

The casino game is then played, such as physical cards being dealt to the players. Based on the dealt cards and any lit light array, the dealer can ascertain which, if any, of the players who made a progressive/fixed amount wager has a predetermined winning set of cards (e.g., a combination of three kings of spades). For a player having such a three kings of spades combination (player has two kings of spades and the dealer has one king of spades as the dealer's "up" card), that player can proceed to another round of play which uses the electronic cards, with the another round of play preferably being the next round. That is, electronic cards, for example, three electronic cards, are provided to the table control, by its associated casino control (or possibly by its master casino control when its associated casino control is the master casino control), which table control is found at the table at which the winning player is playing. If those electronic cards match one of a number of pre-established winning sets of cards, the player wins the payout associated therewith, which can be millions of dollars. After any determination and steps related thereto are taken regarding such a set of cards as three kings of spades, the dealer might also pay any and each player for any other wager (side bet or bonus type of wager) that needs to paid or acknowledged before any further cards are dealt. Additionally or alternatively, after all cards have been dealt, one or more winning hands associated with the base or underlying card game can be paid by the dealer for each player who made a base game wager. Once all bets are settled for each player, the next round of game play can begin.

Based on the foregoing, the present invention can incorporate both physical and electronic cards in playing a casino card game. In that regard, the method of play relies on essentially the same probability of occurrence of winning hands (such as combinations of three kings of spades) in possible back-to-back rounds of play, which can lead to an unusually large payout. With the initial round played using physical cards and the possible subsequent round played using electronic cards. In one embodiment, the subsequent round with electronic cards can utilize a fixed amount for possible payout that is always higher than a progressive jackpot. The invention's system can include a central control, one or more casino controls (with one being designated a master casino control) and a number of table controls. The central control is preferably in communication with the master casino control using the Internet. Each other casino control preferably communicates with the master casino control, and not directly with the central control. Such communication could also be achieved using the Internet. Each casino control is in communication with its associated table control(s) and each casino control can receive game play information from its associated table controls. The central control can be owned or controlled by a third party, who can provide reports and other information to one or more casino owners related to game play and table usage. Such game play information might be used to determine payments owed the third party for system table game usage. Obtaining information by the central control can be pursuant to the permission and/or authority of one or more casino owner(s)/controlling entity or entities. The system's token detection apparatus utilizes un-modulated light technology to automatically determine whether or not a token is present during table game play, particularly during play of a casino card game, including blackjack or a blackjack variant game, such as "Spanish 21". Since un-modulated light is sent and received when detecting that a token is present, it is important that only certain light be indicative of the presence of a token. Accordingly, ambient light must not affect proper and accurate determinations of whether or not a token is present. In that regard, non-ambient light, preferably light in the infrared range, is utilized to detect a token's presence. More preferably, only infrared light within a well-defined range is used for detection. The emitter used to emit un-modulated light has sufficient power and the receiver used to detect un-modulated light has sufficient sensitivity to un-modulated light in the desired range in order to achieve proper detection. In addition, the light path member contributes to token detection by assisting in the desirable locating of the un-modulated light. That is, emitter light is guided to the progressive/fixed amount wager area (and the token when present) and returned light is guided to the receiver when the token is present. According to one embodiment, the present invention also has a unique casino table design including employment of a layer with recesses that allow for increased thicknesses of cable due to bending of the cable at certain locations. Such bending is associated with the related ability of being able to connect the wires of the cable in two different ways to sensor housing circuitry connector plugs.

Additional advantages of the present invention are readily apparent, particularly when taken together with following descriptions including the accompanying drawings.

DETAILED DESCRIPTION

Figure 1:
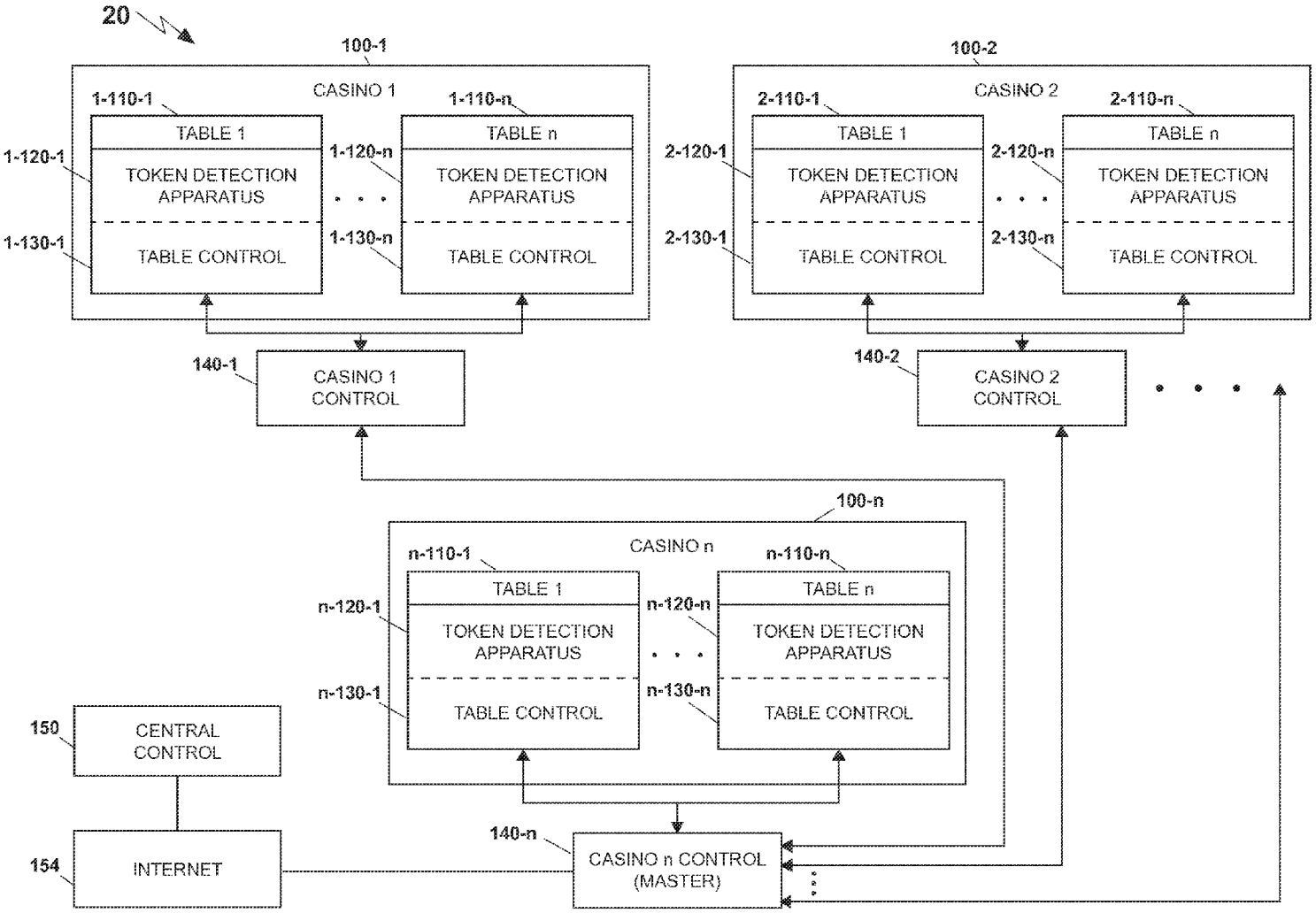
FIG. 1 is a block diagram that illustrates one system of the present invention having a central control, a plurality of casino controls and a number of table controls, which system is devised for use with a plurality of casinos, with each having a number of table games at which multiple wagers can be made.

With reference to FIG. 1, a system 20 for playing one or more casino table games, which are available in one or more casinos, is illustrated. A plurality of casinos 100, namely: 100-1, 100-2 . . . **100-*n*, are diagrammatically depicted. Each casino 100 can be located or housed in a different geographical area or facility. Each casino 100 can be owned or controlled by a different entity or more than one such casino 100 can be owned or controlled by the same entity. Each casino 100 can include a number of tables 110, such as casino 100-1 having tables 1-110-1 . . . 1-110-*n* at which the same or different casino table games can be played. Each casino's tables 110 can be further arranged or located in one or more pits or other areas that define the locations of the table games in the particular casino 100**. The table games can include any one of a number of available, or later available, casino table games. In certain embodiments, the table games include Blackjack/Twenty-One, as well as variants thereof, such as "Spanish 21" and games (e.g., Twenty-One and "Spanish 21") that can include the feature or game variant identified as "Match The Dealer." Both "Spanish 21" and "Match The Dealer" are registered trademarks of the assignee of this application. More specific descriptions related to playing particular table games in the context of the present invention will be provided hereinbelow.

Each gaming table 110 of each casino 100 also has a token detection apparatus 120 associated therewith. For example, tables 1-100-1 . . . **1-100-*n* include, or have as part thereof or associated therewith, token detection apparatuses 1-120-1 . . . 1-120-*n*, respectively. Each such apparatus 120 is used in detecting one or more tokens or betting chips used by players to make certain wagers as part of playing the particular table game. Each token detection apparatus 120 includes at least a table control 130, which can be a single board computer involved with numerous processing, determining-related and reporting functions. The token detection apparatus 120** will be subsequently described in detail, including additional elements and operations thereof for use in detecting when a token is used by a player to make a particular wager (e.g., progressive fixed/amount wager), which is different than a base wager that is made in order to play the underlying table game.

The system 20 also includes at least one casino control 140 that communicates with each table control 130 of each token detection apparatus 120 that is associated with a particular casino 100. Such communications for each casino control 140 could be achieved using one or more network switches (not shown) to which each associated table control 130 is connected. Casino1 control 140-1 communicates with each table control 1-130-1 . . . **1-130-*n* associated with casino 100-1, such as through one or more network switches. Similarly, casino n control 140-*n* communicates with each table control n-130-1 . . . n-130-*n* associated with casino 100-*n*, such as through another one or more network switches. In a preferred embodiment, one of the casino controls 140 is designated as the master casino control, such as casino n control 140-*n*. Each casino control 140 comprises one or more processors, computers and/or servers and has a number of functions, including functions that involve communications between the designated master casino n control 140-*n* and each of the other casino controls 140, with one or more such communications being the result of communications between the master casino n control 140-*n* and a central control 150. The central control 150 can be connected to the master casino n control 140-*n* using the Internet 154. The master casino n control 140-*n* can communicate with the other casino controls 140 using the Internet as well, or using another appropriate network. In the embodiment in which the system 20 has a single casino control 140**, it is deemed to be the master casino control and provides the master casino control functions.

One of the main functions of the central control 150 involves providing information related to electronic cards to each casino control 140 by means of the master casino n control **140-*n*. Such information is to be used by the particular casino control 140** in providing electronic cards.

Whenever at least one player, playing a particular table game having a particular token detection apparatus 120 associated with it, has met certain play requirements involving use of physical or regular (not electronic/digital) cards, that player is automatically eligible to play another round, without any additional wager. In this subsequent round, the player has an opportunity to win a fixed, substantial amount, typically in the millions of dollars. Depending on the electronic cards that are provided by the casino control 140, the player might win one of a number of amounts of money, which amounts can be identified using a payout table or chart related to this aspect of game play that utilizes electronic cards.

With respect to the electronic cards that are used, during setup/installation of the system 20, each of the one or more casino controls 140 obtains a plurality of random numbers, such as three random numbers. When the one player achieves the game play requirements (e.g., has a predetermined combination of cards), upon request of the associated table control 130, the particular casino control 140 communicating with that table control 130 decrypts and converts the three random numbers to produce three electronic cards. These three cards represent two player cards and one dealer card and they are sent to the associated table control 130 found at the table 110 at which the player of interest is playing. And, these three random numbers are also sent to each table control 130, which is in communication with that particular casino control 140. If that particular casino control 140 is not a master casino control, then the master casino control can send the three random numbers to each of the other casino controls 140 in the system 20. The master casino control, if not the particular casino control 140 associated with the player of interest, already has the three random numbers since the master casino control received them from the central control 150 and previously provided them to this particular casino control 140. Similarly, the master casino control provided three random numbers, which are preferably different, to all other of its associated casino controls 140, as well as having its own three random numbers, all of which are known to the master casino control and to the central control 150. In one embodiment, the central control 150 provides two additional or spare sets of three random numbers each to the master casino control for storage and possible later use.

Like the particular casino control 140 communicating with its associated table control(s) 130, including the table control 130 (such as table control 1-130-1) having the player of interest, each of these other casino controls 140, as well as the casino control 140 that is the designated master casino control, decrypts and converts the received three random numbers to three electronic cards. When the particular casino control 140 is the only casino control 140 in the system 20 and therefore is the master casino control, the associated token detection apparatus 120 (such as 1-120-1), as well as all other token detection apparatuses 120 (such as 1-120-2 . . . **1-120-*n*) in communication with the particular casino control 140 (such as 140-1), can be used in displaying or otherwise providing these electronic cards that are received from the particular casino control 140 (such as 140-1). As discussed later herein, each token detection apparatus 120 includes a progressive jackpot display that can include, or be associated with, a video monitor. If the particular casino control 140-1 is not the master casino control, such displays/monitors of the token detection apparatuses 120 in the system 20**, in communication with the master casino control, can also be used in displaying these electronic cards. If such cards are a match to one of the winning hands identified by an electronic cards-related payout chart, the one player wins the amount corresponding to the winning cards.

In the context of the "Match The Dealer" game or feature that can be part of a Twenty-One or a "Spanish 21" table game, basic steps or operations related to later use of electronic cards can be conducted. More specifically, a player can make a base game wager related to the outcome of a round of the particular casino game being played by that player, such as a wager related to playing Twenty-One or "Spanish 21," which outcome depends on the physical cards being dealt to the player and the game rules. The player can also make a bet involving the "Match The Dealer" part of the Twenty-One or "Spanish 21" game by placing a token on a bonus wager area, which is available for that player to use. The method of play involving the "Match The Dealer" game is described in U.S. Pat. No. 5,866,065. Basically to win the "Match The Dealer" bet, one or both of the player's initial two cards must match, in one or both of rank and suit, the dealer's initial "up" card. The player can also place a progressive/fixed payout bet, related to the "Match The Dealer" bet, by placing a token on a progressive/fixed payout wager area, which is available for that player to use.

For the progressive/fixed payout bet, the following table identifies, in one embodiment, each winning set of cards (player cards and dealer's "up" card) and its associated payout.

Card Sets (Player Cards and Dealer "Up" Card) Payouts
2 Suited Kings (Spades) Predetermined $1^{st}$% of Jackpot
2 Suited Kings (Hearts, Diamonds, Clubs) Predetermined $2^{nd}$% of Jackpot
2 Suited Matches Predetermined $3^{rd}$% of Jackpot
(Queens through 2s)
1 Suited and 1 Non-suited Match Fixed Amount
(Kings through 2s) (Not paid from Jackpot)
1 Suited Match Fixed Amount
(Kings through 2s) (Not paid from Jackpot)
2 Non-suited Matches Fixed Amount
(Kings through 2s) (Not paid from Jackpot)
1 Non-suited Match Fixed Amount
(Kings through 2s) (Not paid from Jackpot)

Similar to the method of playing the "Match The Dealer" game, a winning hand associated with the progressive/fixed payout bet is determined using the initial two cards dealt to the player and the initial "up" card dealt to the dealer. Consequently, any winning hand or set of player and dealer cards is determined before continuing play after such initial cards have been dealt. Dissimilar to the "Match The Dealer" bet, for certain sets of cards (winning hands), such as noted in the payout table, the payouts for these winning hands are paid from a jackpot and are a percentage of the current jackpot. By way of example only, the predetermined jackpot first percentage might be 100%; the predetermined jackpot second percentage might be 10%; and the predetermined jackpot third percentage might also be 10%. Regarding the jackpot amount, the house or casino might seed the jackpot with a desirable or pre-established amount that contributes to the success of the progressive game, such as $1000 or more. This seed amount is used whenever the entire jackpot is paid out. The amount of the jackpot can increase using the amounts wagered by the players using their respective progressive/fixed payout wager areas. And, any such increase can include, or be based on (e.g. be a percentage or a fixed portion of), the progressive/fixed amount wagers made by the players that were not associated with winning hands, as well as such wagers that were associated with winning hands. Furthermore, any such increase can be based on progressive/fixed amount wagers placed at other tables 110 in the same casino 100 and/or such wagers placed at one or more other tables 110 located at one or more other casinos 100. With respect to payouts, as the above table/chart indicates, some of the payouts are a percentage of the jackpot, while other payouts are fixed amounts that are not paid from the jackpot. Consequently, whenever fixed amount payouts are made, the jackpot is not decreased by the amounts of the payouts. Fixed amount payouts that are made based on progressive/fixed amount wagers are typically substantially lower than payouts made for the "Match The Dealer" bet. For example, these fixed amount payouts can be about 25% of the corresponding "Match The Dealer" payouts.

In the case in which a player has a combination of three kings of spades (player's two kings of spades matches the dealer's one king of spades) after a progressive/fixed amount wager is made, not only is the winning player entitled to the amount set out in the above list or chart of card sets and payouts, the winning player, in a preferred embodiment, is also eligible to play another round using the electronic cards. Play involving the electronic cards has the potential for additional and high fixed payouts. This embodiment or option could be termed "Go For The Millions (GFTM)" and can be structured as follows: (a) a player must make a progressive/fixed amount wager (associated with a "Match The Dealer" bet, for example) and then achieve a combination of three kings of spades winning set of cards (two kings of spades initially dealt to the player and one king of spades initially dealt to the dealer as the dealer's "up" card); and (b) that player, during a next round of play, must achieve another three kings of spades combination (or some other suited three card combination). If that happens the player wins a fixed payout in the millions, such as ten million dollars for a particular progressive/fixed amount wager, such as a $5 wager. As an additional option, that player, during such round of play, might also win by achieving another one or more winning hands, such as three kings of clubs, diamonds or hearts (each suited) combination. The fixed payout amounts in such instances would be less than the combination of three kings of spades payout, but still a substantial amount, such as five million dollars based on a $5 wager. As can be appreciated, there could be additional winning card sets with lesser corresponding payouts, such as card combinations/sets of: two suited queens matches, two suited jacks matches, two suited tens through twos matches etc. In conjunction with providing sets of random numbers to the one or more casino controls 140, the central control 150 can have and use random number generator means to properly generate random numbers. In the embodiment where three random numbers are initially provided to each casino control 140 during setup or installation using a master casino control that receives them from the central control 150, when the three random numbers are used by a particular casino control 140, which is the designated master casino control, it requests another three random numbers from the central control 150. It then stores this requested set of three random numbers with its other two sets. Prior to such a request to the central control 150, if the master casino control is not the particular casino control that used the three random numbers, then the particular casino control 140 receives from the master casino control one of its two sets of spare random numbers.

There can also be certain communications between the table controls 130 and their associated casino controls 140. Upon power being applied to a table control 130, its associated casino control 140 could download a player instructional/promotional video to that table control 130, if that table control 130 does not have the latest version. The program that runs the table control 130 could also be downloaded from that casino control 140, if the table control 130 does not already have the latest version. Pay tables or charts related to use of one or both of physical and electronic cards could be downloaded, as well as one or more wager amounts that the player must make to be able to play one or more parts of the game (base game, side bet/bonus game portion and progressive/fixed amount game portion). Similarly, updates or other changes can be provided by the designated master casino control to any other casino controls 140 at power up, or when the master casino control implements a change applicable to all casino controls 140, including when one or more changes are provided to the master casino control by the central control 150.

The central control 150 can also have other responsibilities involving each casino control 140 related to play at the gaming tables 110. In one embodiment, after each round of play, each table control 130 can send the following to its associated casino control 140: a table identifier associated with the table 110 at which the particular table control 130 is used or found and the number of wagers at each such table 110. If there is a single casino control 140 in the system 20, that casino control 140, functioning as a master casino control, can send such information to the central control 150. When the system 20 includes a plurality of casino controls 140, each casino control 140 sends such information to that casino control 140 which is the designated master casino control. The master casino control combines such information for sending to the central control 150. In addition to receiving such information, the central control 150 keeps track of the number of random numbers currently stored at each casino control 140, the actual numbers of such random numbers, and, for each actual number, when each was sent to each casino control 140.

According to a preferred embodiment, the central control 150 is located off site from each casino 100 and it is owned, or otherwise controlled, by a third party, who does not own or control any casino 100 and who is not affiliated with any such casino 100 owner or controlling entity. This third party can receive information related to game play, such as the number of hands played, from each of the tables 110 in the system 20 using the central control 150 and can use the same in its billing system for providing bills/invoices to the one or more owners and/or controlling entities of the casinos 100 to determine the amount or fee that each casino should pay the third party for use of the system 20. For example, a monthly fee due the third party could depend on the amount/degree of usage of game play at the tables 110, with no amount due for a particular table 110, if the game were not being played at that table 110 for any and/or each predetermined time period. In addition to such invoices, the casino owner could receive game play information on a periodic basis by downloading the same using one or more of the casino controls 140 and/or using that casino control 140 which is the designated master casino control. The third party can also be responsible for any fixed amount payout made to a player for winning the GFTM round. The payout table associated with this GFTM play can be established by the third party, while the amounts paid based on the payout table associated with the progressive/fixed amount wager can be the responsibility of the casino owner or controlling entity. Even though such responsible entities can be different, the progressive/fixed amount wager, and payouts associated therewith, can be determined independently of the GFTM payouts. That is, the casino owner or its controlling entity can independently determine, and change, the amount of the progressive/fixed amount wager and/or the payouts associated therewith without directly taking into account the GFTM payouts to be paid by the third party; however, the periodic fee due the third party by this entity could change.

Figure 2:
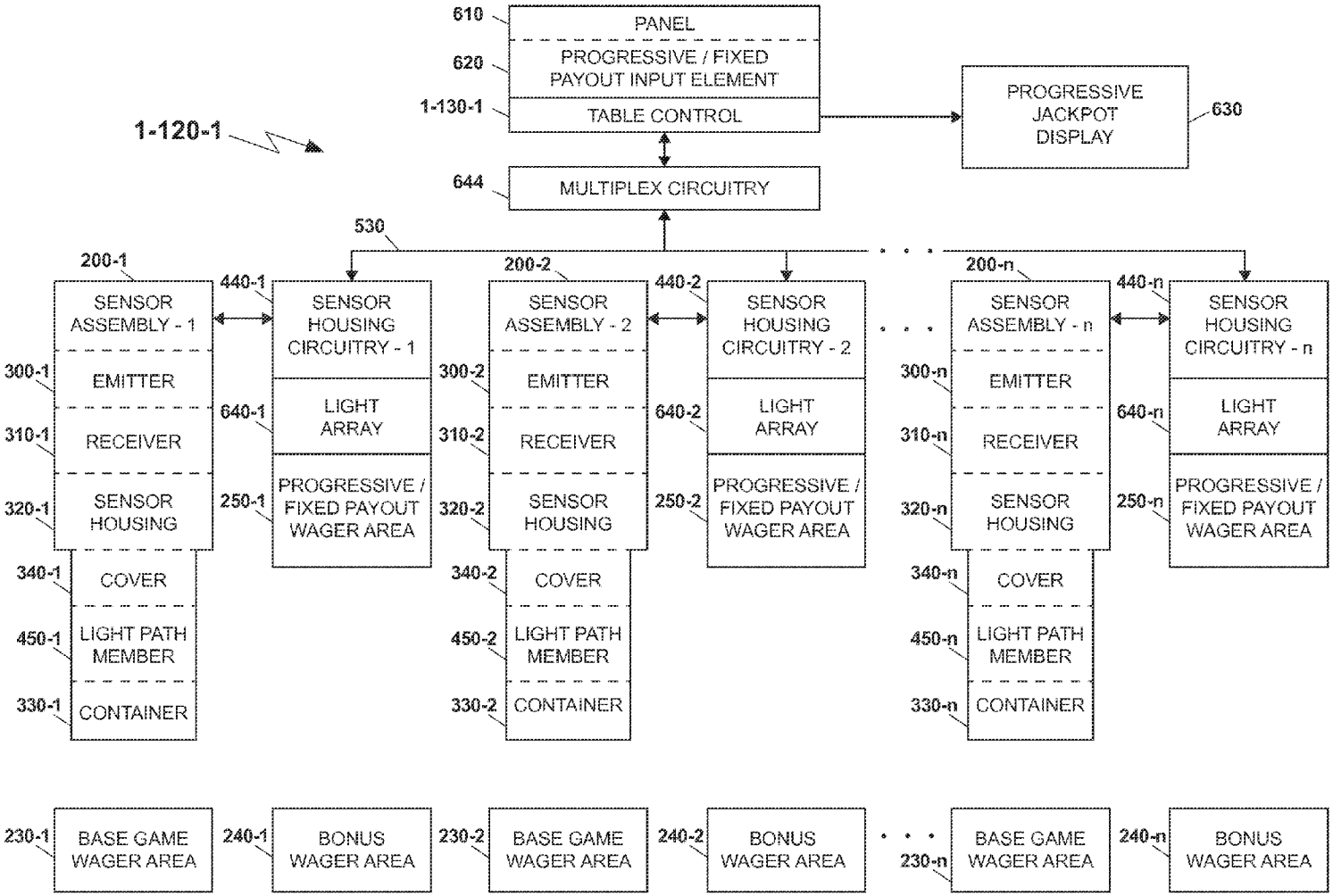
FIG. 2 is a block diagram showing components of the token detection apparatus, which is diagrammatically depicted in FIG. 1.

With reference to FIG. 2, a token detection apparatus 120 is next described using the token detection apparatus 1-120-1 since all such apparatuses 120 are the same. In addition to the table control 1-130-1, the apparatus 1-120-1 includes a plurality of sensor assemblies 200 including sensor assemblies 200-1, 200-2 . . . **200-*n*. In the preferred embodiment, these sensor assemblies 200 are held or otherwise supported by one of the tables 110, with the top portions of the sensor assemblies 200 being substantially even with the top of the table 110. Each sensor assembly 200 is used in detecting whether or not a token or chip is present indicative of a particular bet being placed and such will be described in detail later herein. Each table 110, such as table 1-110-1, has a felt made with a top surface having typical or known gaming displays including a number of base game wager areas or sections 230. The number of these corresponds to the number of sensor assemblies 200 so that corresponding base game wager areas 230-1, 230-2 . . . 230-*n* are provided. Each base game wager area 230 can be used by the player to place a bet in that area related to the particular casino table game that is being played. For those games that include the "Match The Dealer" game or feature or some other side bet option, there are a number of bonus wager areas 240-1, 240-2 . . . 240-*n*, which number of such wager areas 240 corresponds to the number of sensor assemblies 200. A number of progressive/fixed payout wager areas or sections 250 are also included. To make a progressive/fixed payout wager, the player places a token on the player's associated progressive/fixed payout wager area 250. In the preferred embodiment, these wager areas 250 are the same as, or defined by, the top portions of the sensor assemblies 200 that are substantially level with the top of the table 1-110-1. Like the base game wager areas 230 and the bonus wager areas 240, there are a number of progressive/fixed payout wager areas 250-1, 250-2 . . . 250-*n*. The number of such wager areas 250-1 . . . 250-*n* could be greater than the number of base game wager areas 230 and/or bonus wager areas 240. Each progressive/fixed payout wager area 250** can be used by a player associated with that particular area to make a progressive/fixed bet related to the particular table game being played.

Each of the sensor assemblies 200-1, 200-2 . . . **200-*n* can have the same components. In that regard, the sensor assembly 200-1 is now described, with the understanding that the following descriptions can also apply to the sensor assemblies 200-2 . . . 200-*n*. The sensor assembly 200-1 includes an emitter 300-1 and a receiver 310-1. The emitter 300-1 outputs un-modulated light when turned on or energized. The receiver 310-1 can receive returned un-modulated light, which is useful in determining when a token is present on the player's associated progressive/fixed payout wager area 250-1, which is defined by the top portions of the sensor assembly 200-1. Regarding these top portions and with reference to the exploded view of FIG. 3 as well, the sensor assembly 200-1 further includes a sensor housing 320-1 that contains the emitter 300-1 and the receiver 310-1. The sensor housing 320-1 comprises a container 330-1 and a transparent cover 340-1, which is removably joined to the container 330-1. The top outer surface of the cover 340-1 can constitute the progressive/fixed payout wager area 250-1. That is, a progressive/fixed payout wager made by a player associated with that particular wager area 250-1 places a token on the top outer surface of the cover 340-1 so that, preferably, most portions of the token are located thereon. The container 330-1 can be substantially cylindrical shaped, with a number of cut-outs 360-1, such as three cut-outs 360-1*a*, 360-1*b*, 360-1*c*, formed in a wall 370 near the bottom thereof. These cut-outs 360-1 are used in receiving mating pieces 380-1*a*, 380-1*b*, 380-1*c* which are part of the cover 340-1, and are used in removably joining the cover 340-1 to the container 330-1 by properly positioning the cover 340-1 on the container 330-1 and then rotating the cover 340-1 relative to the container 330-1. Held within the container 330-1 is a support member 390-1 having two elongated holes 400-1, 410-1. The elongated hole 400-1 receives and is used in maintaining the emitter 300-1 in a desired, aligned position within the sensor housing 320-1. The elongated hole 410-1 receives and is used in maintaining the receiver 310-1 in a desired, aligned position within the sensor housing 320-1. The support member 390-1 is generally centrally located and extends essentially upwardly from the bottom of the container 330-1. A printed circuit board 420-1 is also located on the bottom of the container 330-1. The circuit board 420-1 has a number of sensor-related circuitry components including a connector or plug 430-1 for use in communicating electrical signals from/to the board 420-1. Sensor housing circuitry 440-1, which is comprised of such components, is represented in a block found in FIG. 2, as well as in the circuit diagram of FIG. 4. At least some of the components of the sensor housing circuitry 440-1 are used in providing signals to be used in determining whether or not a token is present on the progressive/fixed payout wager area 250-1**, as will be discussed later herein.

In addition to the mating pieces **380-1*a*, 380-1*b*, 380-1*c* and at least portions of its top, outer surface constituting the progressive/fixed payout wager area 250-1, the cover 340-1 also has a light path member 450-1. This member 450-1 can be formed integrally with the top, inner surface of the cover 340-1. The light path member 450-1 is generally conical shaped with a substantially flat base joined to the cover 340-1 inner surface. The cone-shaped portions extend away from the cover 340-1 inner surface so that, when the cover 340-1 is joined to the container 330-1, these portions are extending inwardly of the sensor housing 320-1. The relatively more narrow portions including the tip of the light path member 450-1 are located farther away from the cover 340-1 inner surface than other portions of the light path member 450-1. The light path member 450-1 is used in controlling the path of light. More specifically, the light path member 450-1 can direct or guide at least some of the light output by the emitter 300-1 towards the progressive/fixed amount wager area 250-1. Consequently, when a token is present thereon (i.e. on the top, outer surface of the cover 340-1), such light will impinge on a desired portion of the inner surface of the cover 340-1, over which cover 340-1 at least some of the token is positioned. Due to the presence of the token and the transparent nature of the cover 340-1, at least some of the light will be reflected thereby. Such reflection means that returned emitter light results from emitter light contacting the token. At least some of such light is affected or guided by the light path member 450-1 in a way that returned emitter light is directed to the receiver 310-1** to be detected using the same.

With regard to the emitter 300-1 and the receiver 310-1, in one embodiment, these are two separate elements and not part of a single or unitary light sensing component. The emitter 300-1 can be a component available from Fairchild Semiconductor and identified as QED234. This is a light emitting diode that outputs un-modulated light in the infrared frequency range and has a peak emission wavelength of 940 nanometers (nm). It is classified as having high output power. In that regard, its maximum power dissipation is 200 milliwatts (mW). Its high output power aspect is important to ensure sufficient or adequate detection of returned emitter light when a token is present. Its medium emission angle is 40 degrees. The receiver 310-1 can be a component from Vishay Semiconductors and which is identified as BPV11F. This is a phototransistor with high radiant sensitivity. It has a daylight blocking filter matched with 940 nm emitters, with the range of spectral bandwidth being 900-950 nms and having a wavelength of peak sensitivity of 930 nm. Its angle of half sensitivity is +/−15 degrees.

Figure 4:
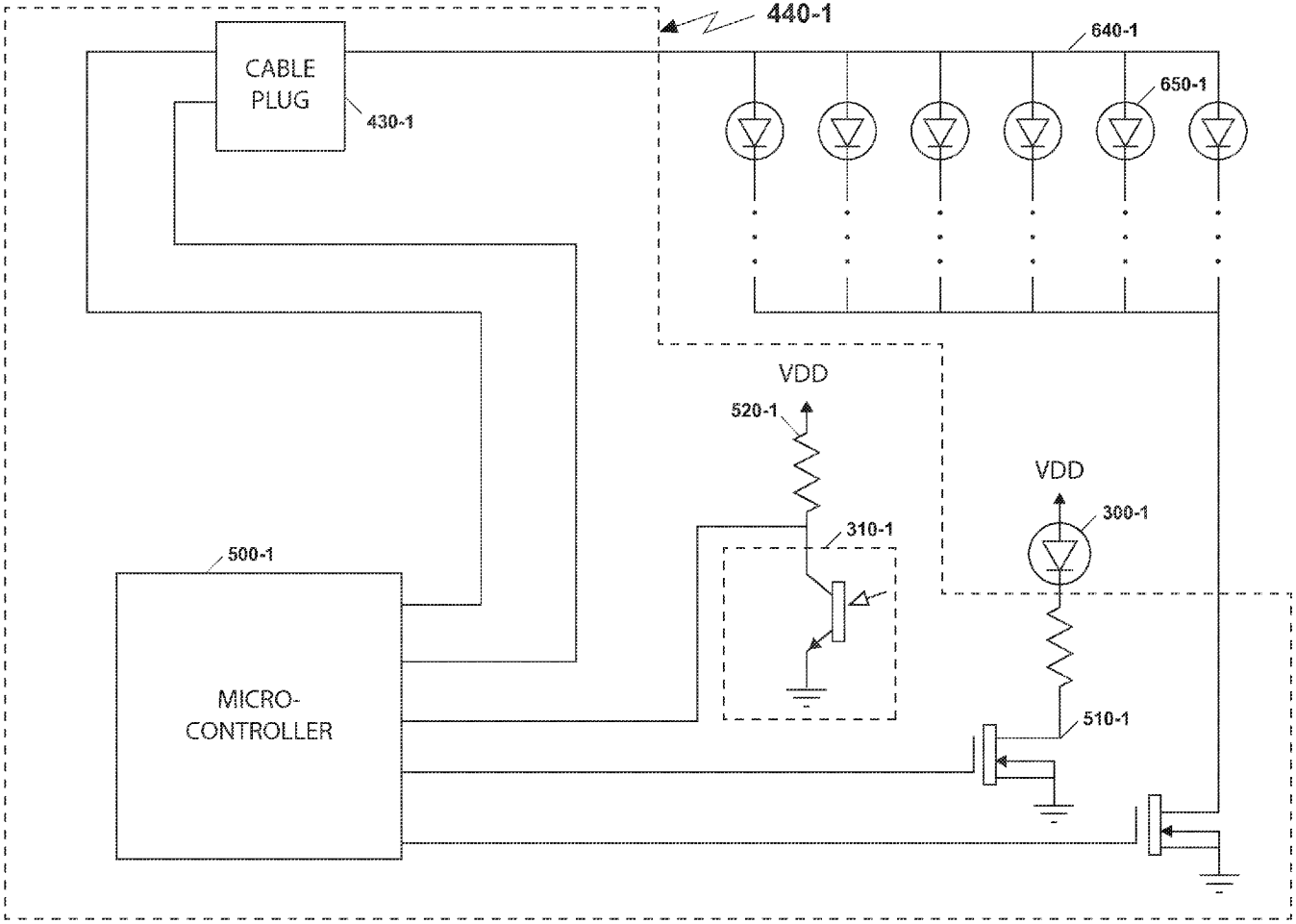
FIG. 4 is circuit schematic illustrating sensor housing circuitry, together with a schematically illustrated emitter and receiver of a sensor assembly, as well as a light array communicating with the sensor housing circuitry.

Further descriptions regarding the connections and communications involving the sensor housing circuitry 440-1 and the emitter 300-1 and receiver 310-1 are provided with reference to FIG. 4. The sensor housing circuitry 440-1 further includes a microcontroller 500-1, a transistor switch 510-1 and a collector resistor 520-1. The emitter 300-1 is connected to the microcontroller 500-1 using the transistor switch 510-1. The receiver 310-1 is connected to the microcontroller 500-1 using the junction defined by a collector resistor 520-1 and the collector of the phototransistor/receiver 310-1. The microcontroller 500-1 is used in providing a light control signal to the emitter 300-1 and is used in providing a light detection signal from the receiver 310-1. These two generated signals have different signal paths that include the plug 430-1. The electrical contacts of the plug 430-1 are electrically connected to a cable 530, as diagrammatically shown with reference to FIG. 2. The cable 530 can preferably be a ribbon cable in which each single wire, or a pair of wires, thereof can carry or communicate a command, a data or another appropriate signal, such as the light control signal or the light detection signal. More specifically, the cable 530 connects to the table control 1-130-1 for use in controlling the operations and functions of the token detection apparatus 1-120-1, including related to determinations concerning the presence or absence of a token on the progressive/fixed amount wager areas 250-1 . . . **250-*n*. The table control 1-130-1 can be held using a housing having an outer panel 610. The panel 610 can be touch enabled and can be used in providing one or more inputs to the table control 1-130-1. The housing, as an example, may be connected to the table 1-110-1 using a table mounting and supporting structure so that the dealer or other operator, can readily access and use the panel 610. The panel 610 may include a progressive/fixed amount input element 620. This element 620 is used by the operator or dealer in connection with initiating determinations related to whether or not one or more progressive/fixed amount wagers has been made for a particular round of game play. The element 620 can be displayed on a screen of the panel 610 and activated by contact or touch. The table control 1-130-1 is also used in controlling the content of a progressive jackpot display or meter 630. The display 630** can visually indicate the current jackpot amount from which one or more winning sets of hands related to a progressive/fixed amount wager can be paid.

In addition to exercising its control related to the light control signal for use in turning on/off the emitter 300-1 and the light detection signal indicative of the presence/absence of a token obtainable using the receiver 310-1, the table control 1-130-1 also communicates with a light array 640-1 of the sensor circuitry, as conveyed by FIG. 2 and schematically illustrated in FIG. 4. Such communication relies on the electrical connection between multiplex circuitry 644 (depicted in FIG. 2) and the cable 530, together with the plug 430-1, which is part of the sensor housing circuitry 440-1. The multiplex circuitry 644 is used in transferring separate, individual signals relative to each of the sensor assemblies 200 associated with the table 1-110-1 and the table control 1-130-1. The light array 640-1 is used in indicating whether or not a progressive/fixed amount wager was made by the player associated with the progressive/fixed amount wager area 250-1 during a particular round of play. The light array 640-1 is located adjacent to the progressive/fixed amount wager area 250-1 and preferably surrounds this area. The light array 640-1 can have a number of light emitting diodes (LEDs) 650-1. When activated or turned on using the table control 1-130-1, the LEDs 650-1 can emit a pulsating or, alternatively, a continuous light indicating that a token is or was present on the progressive/fixed amount wager area 250-1 for a particular round of play.

Generally, the table control 1-130-1 can either send commands to the sensor assembly 200-1 or receive data therefrom after sending a command for such data. The commands can relate to controlling the emitter 300-1 and the light array 640-1 and to obtaining data or information involving the receiver 310-1. For such communications, any such command can include the identity of the sensor assembly 200, such as the sensor assembly 200-1 when the command is directed to it. The specific or particular type of command can also be provided by the table control 1-130-1 using applicable software, with the command, for example, for activating the light array 640-1 being different than the command for obtaining data related to the receiver 310-1. In one embodiment, a command for obtaining data related to the receiver 310-1 also results in the emitter 300-1 being turned on, while a different command obtains data related to the receiver 310-1 during a time when the emitter 300-1 is off or de-activated. In a one embodiment, each sensor assembly 200 is pre-programmed to have a particular identifier (e.g. using decimal 15). Its associated table control 130 controls or changes this identifier so that its identifier or identity is different from the identifiers of the other sensor assemblies 200 used with that table 110. Similarly, when a particular sensor assembly 200 is replaced with a new sensor assembly 200, the associated table control 130 changes this pre-programmed identifier to the identifier of the sensor assembly 200 it replaced. This process may be essentially automatic or semi-automatic.

Figure 5:
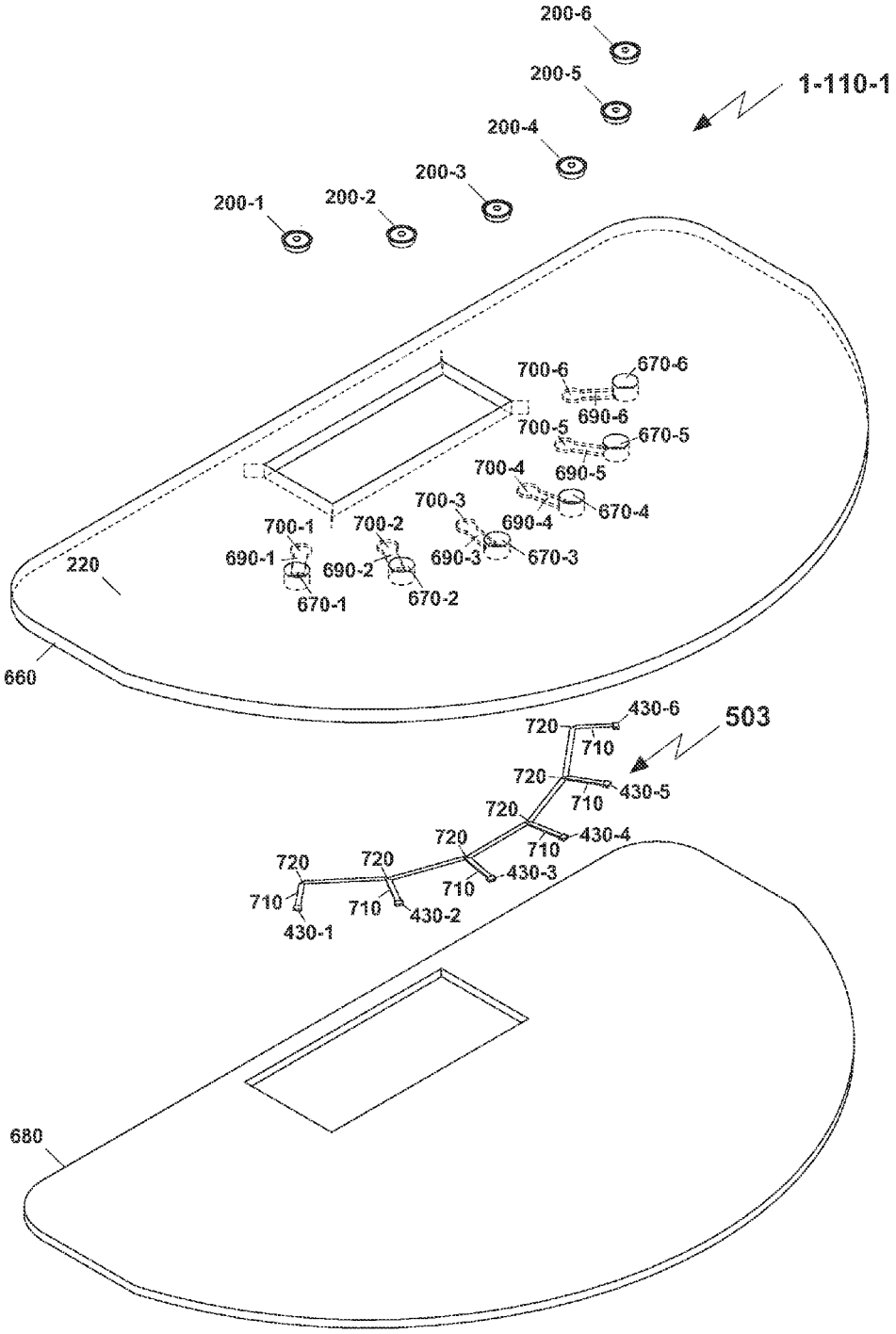
FIG. 5 illustrates portions of an embodiment of a casino gaming table depicting layers of the table and certain positions of the cable, which is useful in electrically connecting together a number of sensor assemblies.

Referring to FIG. 5, one embodiment of a casino table 110, such as casino table 1-110-1, is shown in an exploded view that illustrates a structure suited for incorporating a number of the sensor assemblies 200. As depicted, there are six sensor assemblies 200-1, 200-2 . . . 200-6 so that n=6, although the table 1-110-1 could have fewer or more sensor assemblies 200. In addition to the table felt 220, the table 1-110-1 includes a foam layer 660 that underlies the felt 220. The foam layer 660 can have a number of cavities 670, namely: 670-1 . . . 670-6, wherein the number of cavities 670 corresponds to the number of sensor assemblies 200 included with the table 1-110-1. The foam layer 660 is shaped so that its perimeter conforms to the top of a typical casino table, such as the table top 680. The foam layer 660 has a desired thickness, which is related to the height of each sensor assembly 200, particularly the height of the container 330. In that regard, the vertical extent or height of each container 330 is essentially no greater than the depth of each cavity 670. In one embodiment, the cavities 670 extend completely through the foam layer 660 so that their depths equal the foam layer thickness. When the sensor assemblies 200 are properly positioned in the cavities 670, the top surfaces of the covers 340 are located minimally above the level of the felt 220. Contiguously adjacent to each cavity 670 is a recess or channel 690, and with a head portion 700 being contiguously adjacent to each recess 690. Accordingly, recesses 690-1 . . . 690-6 are adjacent to cavities 670-1 . . . 670-6, respectively. And, head portions 700-1 . . . 700-6 are adjacent to recesses 690-1 . . . 690-6, respectively. The recesses 690 are used to receive or hold certain sections of the ribbon cable 530. That is, except for a last sensor assembly (such as sensor assembly 200-6), which is the last one in the chain of sensor assemblies 200 electrically interconnected by the cable 530, there are two ribbon cable sections 710 extending between each cable plug 430-1 . . . 430-6 and cable bent portions 720. The cable bent portions 720, as illustrated in FIG. 5, constitute certain portions of the cable 530 that are bent or folded over so that these cable bent portions 720 are created along the extent of the cable 530 as it interconnects each of the six sensor assemblies 200. The size and depth of each head portion 700 is sufficient to contain or hold bent portions 720. Similarly, the size and depth of each recess 690 is sufficient to contain or hold two cable sections 710, which sections substantially overlie each other. In one embodiment, the depth of the recesses 690 is the same as the depth of the head portions 700, each of which depths is less than that of the cavities 670. The size of the head portions 700 can be different than the size of the recesses 690 to better accommodate the space taken up by the bent portions 720. Such containment or storage of these cable sections 710 and cable bent portions 720 achieves desirable and advantageous placement of the ribbon cable 530 along the table 1-110-1. With respect to the sensor assembly 200-1, its second cable section 710 can be extended to the table control 1-130-1 for connection thereto and thereby complete electrical communications between each of the six sensor assemblies 200 and the table control 1-130-1.

Figure 6A:
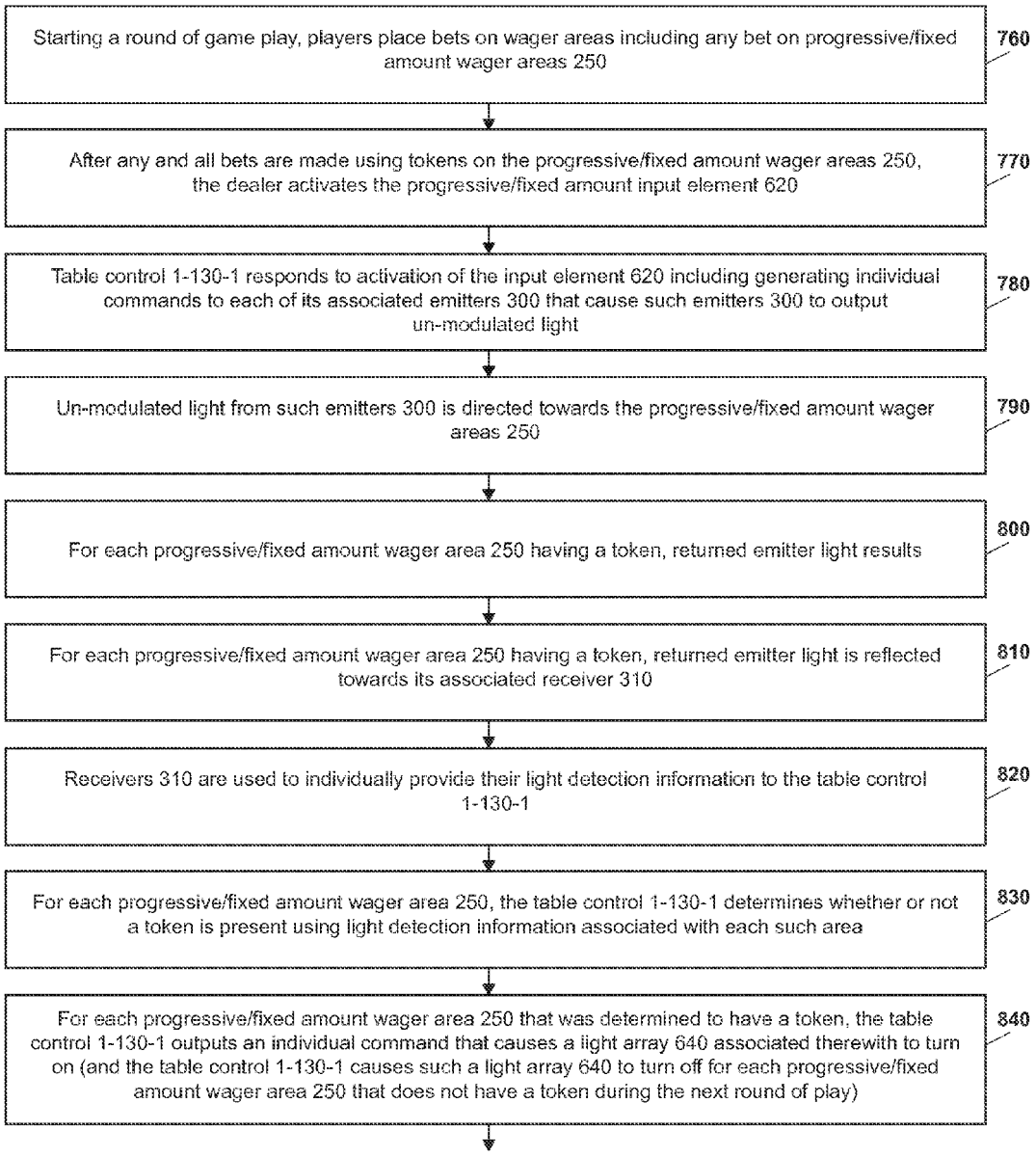
FIGS. 6A-6C are flow diagrams that provide basic steps or stages associated with the invention's method of operation, particularly related to token detection and use of physical and electronic cards.
Figure 6B:
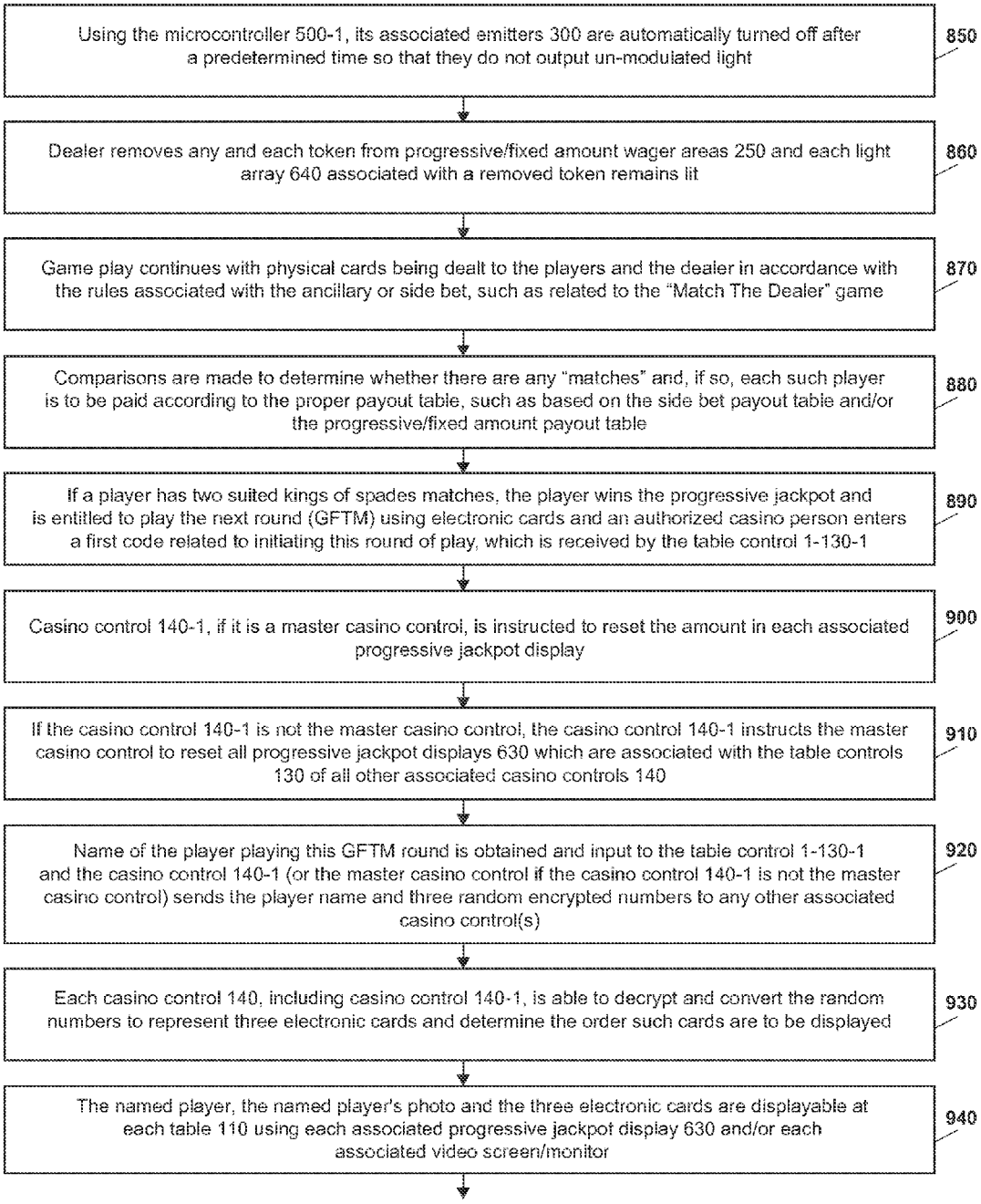
Figure 6C:
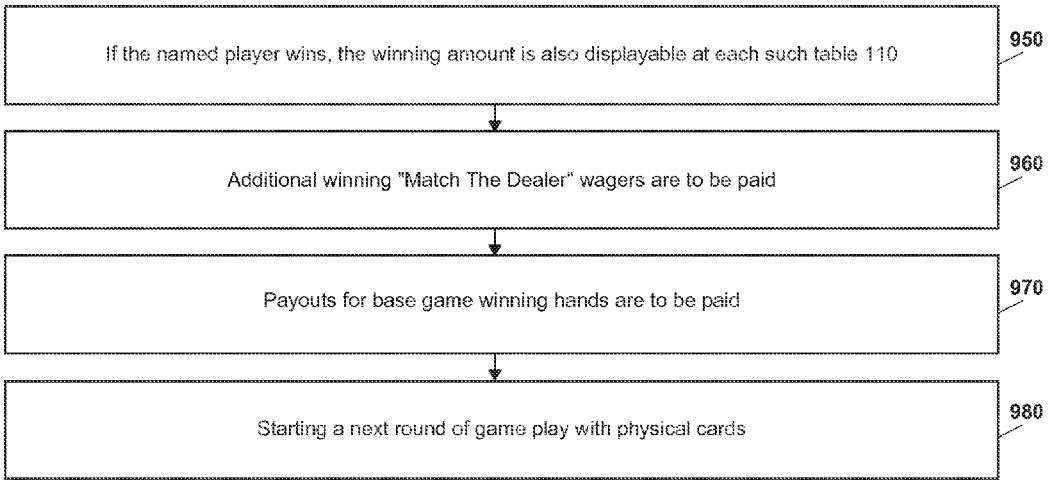

Referring particularly to FIGS. 6A-6C, steps or stages, related to the method of game play or operations involving hardware and software of the present invention, are next discussed in the context of a single table 1-110-1 located in casino 1 100-1. With reference to block 760, a round of game play can begin with players making their bets including any progressive/fixed amount wagers, which can be placed by one or more players on the top surfaces of the covers 340 (progressive fixed/amount wager areas 250) of their associated sensor assemblies 200. An associated sensor assembly 200 is located on the table 1-110-1 near where the player is sitting or playing. In the embodiment of FIG. 5, up to six players can play and make as many as six progressive/fixed amount wagers. Once the dealer determines that all bets that can be made have been made, as stated in block 770 of FIG. 6A, the dealer then activates the progressive/fixed amount input element 620, such as by contacting a button associated therewith on the panel 610. The table control 1-130-1 responds to this activation or engagement by generating individual commands, separately and sequentially, to each of the sensor assemblies 200-1 . . . **200-*n* of FIG. 2, as conveyed in block 780. These commands result in light control signals being generated. With respect to FIG. 4 and sensor assembly 200-1, for example, a light control signal for this assembly 200-1 is output by the microcontroller 500-1 and is used in turning on the emitter 300-1. As can be understood, such a command associated with the assembly identified as the sensor assembly 200-1 is carried from the table control 1-130-1 to the multiplex circuitry 644 and then by the ribbon cable 530 to the plug 430-1 to be transmitted using the sensor housing circuitry 440-1 to the emitter 300-1. This process is repeated for each of the other sensor assemblies 200-2 . . . 200-*n* provided with the table 1-110-1**.

Essentially simultaneously with turning on the emitters 300, readings or determinations are initiated concerning whether or not any token is present on one or more or the progressive fixed amount wager areas 250. Regarding that, with the emitters 300 having been turned on, at least some un-modulated light output therefrom is directed or guided towards each of the progressive/fixed amount wager areas 250, as noted by block 790.

Figure 3:
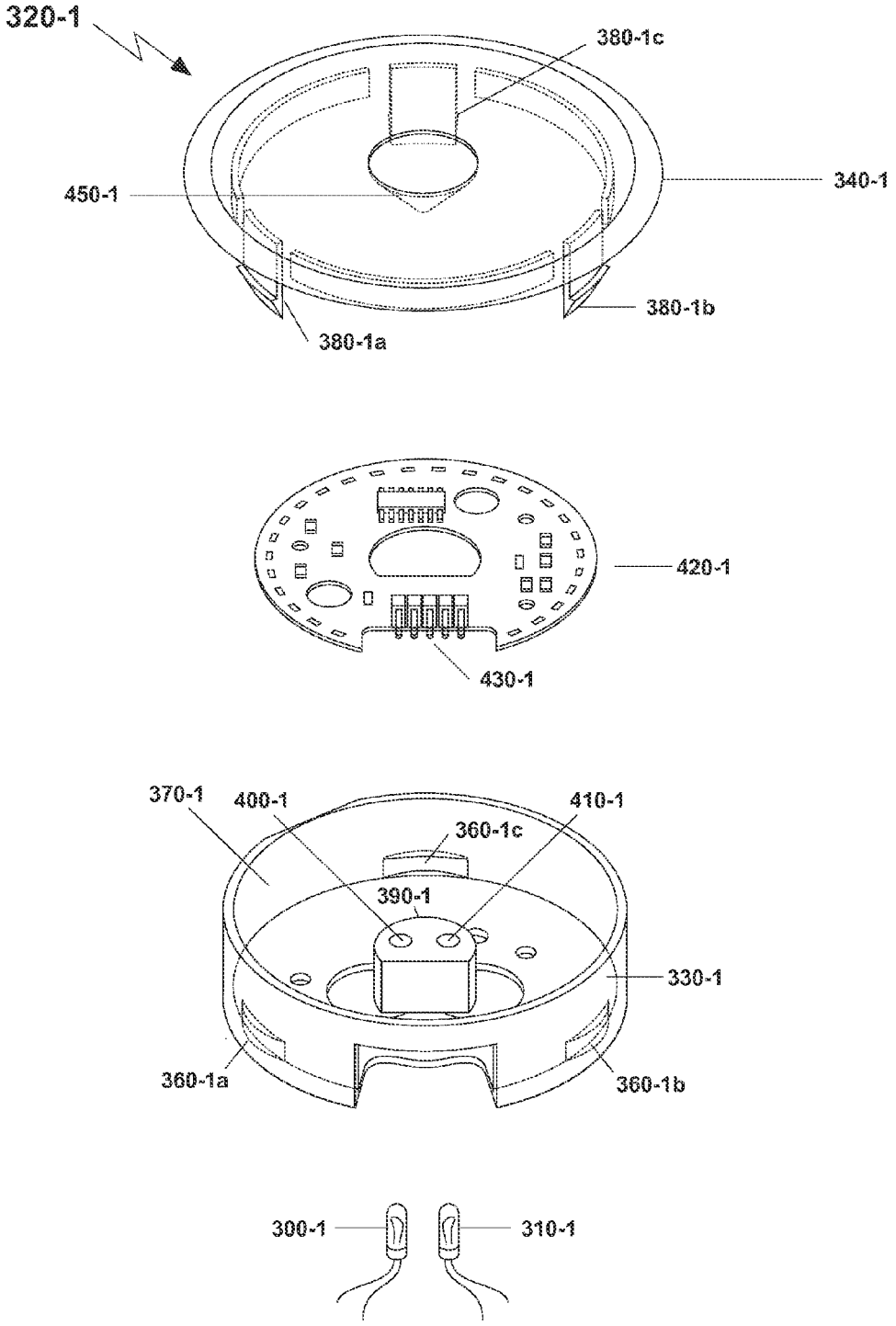
FIG. 3 is an exploded view illustrating components of the sensor assembly, including the cover, container and light path member, of the token detection apparatus.

Referring to the sensor assembly 200-1 and FIG. 3, the un-modulated light output by the emitter 300-1 is directed using the conical-shaped light path member 450-1 towards the progressive/fixed amount wager area 250-1. In the case in which this wager area 250-1 has a token placed thereon, returned emitter light results, as provided by block 800. As can be appreciated such returned emitter light results for each sensor assembly 200 that has a token in a corresponding progressive/fixed amount wager area 250. Conversely, no returned emitter light results from those areas 250 that do not have a token. To provide adequate or sufficient returned emitter light indicative that a token is present, it is necessary that at least a majority of the token be in contact with the top of the cover 340. If the token is only partially on a cover 340, inadequate returned emitter light might result, thereby leading to a false indication that no token is present.

As indicated by block 810 for each progressive fixed/amount wager area 250, such as progressive/fixed amount wager area 250-1, having a token, at least some of the returned emitter light contacts the light path member 450-1 and its shape or geometry causes returned emitter light to be directed towards the receiver 310-1. The receiver 310-1 captures at least portions of returned emitter light. Referring to FIG. 4 as well, when returned emitter light is present, the receiver 310-1 outputs a light detection signal that is processed using the sensor housing circuitry 440-1 including the microcontroller 500-1 to provide a processed light detection signal or information to the plug 430-1. The light detection information associated with the receiver 310-1 is carried to the table control 1-130-1 using the ribbon cable 530 and the multiplex circuitry 644. Similarly, light detection information for each receiver 310 is sequentially sent by its associated sensor housing circuitry 440 from its plug 430 to the table control 1-130-1 with which they communicate, as denoted in block 820. Block 830 indicates that the appropriate or associated table control 130, such as the table control 1-130-1, determines whether or not a token is present for each progressive fixed/amount wager area 250 using the associated light detection information. With respect to the progressive fixed/amount wager area 250-1 and with a token present thereon, the table control 1-130-1 uses the light detection information related to the receiver 310-1 to determine the token's presence. Such determination can include a comparison involving the magnitude or level of the light detection information and a threshold or comparison value. That is, the light detection information associated with the receiver 310-1 has a magnitude or level that equals or is greater than (alternatively, less than) the value it is compared with, thereby leading to a determination by the table control 1-130-1 that the sensor assembly 200-1 has a token associated with it.

With reference next to block 840 of FIG. 6A, the table control 1-130-1 uses the determinations it makes related to the light detection information provided by each sensor assembly 200 and its associated progressive/fixed amount wager area 250 to output a command or control signal to cause any and each light array 640 associated with a sensor assembly 200 that has a token to light. In the case of a token being present in connection with a progressive fixed/amount wager area 250-1. Referring once again to FIGS. 2 and 4, such a control signal is carried from the table control 1-130-1 using the multiplex circuitry 644 and then by the cable 530 to the plug 430-1, where it is subsequently input to the microcontroller 500-1. In response, the microcontroller 500-1 outputs a signal that results in a ground applied to the light array 640-1. Consequently, the LEDs of the light array 640-1 are energized or lit by the power they then receive. As can be understood, for any sensor assembly 200 not having a token associated therewith, a command or control signal can be generated using the table control 1-130-1 so that its corresponding light array 640 is not energized. Parenthetically, in one embodiment, any light array 640 that was energized remains lit until there is a subsequent round of game play in which no token is present (no progressive fixed/amount wager is made). For example regarding the progressive fixed/amount wager area 250-1 and with its associated light array 640-1 being lit due to the presence of a token, the light array 640-1 continues to be lit so long as a token is used to make a progressive/fixed amount wager. However, for any such subsequent round where there is no token present, the table control 1-130-1 can send a command or control signal that causes the light array 640-1 to turn off.

Referring now to block 850 of FIG. 6B and continuing the discussion related to a particular round of game play, in addition to making determinations using the light detection information that was provided using each of the receivers 310, the table control 1-130-1 also controls the activation and de-activation of its associated emitters 300, as well as obtaining light detection information from its associated receivers 310, using the microcontroller 500-1. That is, a single command output by the table control 1-130-1 to the microcontroller 500-1 can result in turning on the associated emitters 300, obtaining the light detection information from the associated receivers 310, and turning off the associated emitters 300. The single command is transmitted from the table control 1-130-1, using the multiplex circuitry 644 and the cable 530, to the plug 430-1 and subsequently to the microcontroller 500-1.

Block 860 concerns a next stage or steps taken by the dealer that occurs after any and each progressive/fixed amount wager has been made and indication thereof is provided using any and each light array 640 being lit that has an associated token. In particular, the dealer picks up, slides or otherwise removes any and all tokens from the progressive/fixed amount wager areas 250 on the table 1-110-1 so that such wager areas 250 do not include any tokens.

After removal of the tokens, each of the light arrays 640, associated with sensor assemblies 200 that detected the token, remains lit. As a consequence, a visual indication of such wagers having been made, based on the energized light arrays 640, is provided to the dealer, players and game observers even when the wagered tokens are no longer present.

Table game play continues after any tokens used to make progressive/fixed amount wagers are removed, including dealing of cards to the players and the dealer, as indicated in block 870. In the case of blackjack or a variant thereof being played, and which includes the "Match The Dealer" feature or game, any progressive/fixed amount wager is made based thereon. Thus, as previously discussed, comparisons are made involving the cards of the dealer and each player who made one or both of a "Match The Dealer" wager and a progressive/fixed amount wager to determine whether their cards "match." For any and each player who made one or both of such wagers and in which the set of cards (player and dealer cards) of any and each such player constitutes winning set, such player(s) is(are) entitled to be paid the corresponding payout amount(s), as stated in block 880. That is, such a player might be paid based on one or both of the ancillary/side bet (e.g. "Match The Dealer" game wager) and/or the progressive/fixed amount wager, depending on which bets were made by such a player. Depending on the cards in the winning set, the payout amount is either to be paid using all or part of the current amount in the progressive jackpot (when a progressive/fixed amount wager was made and the progressive/fixed amount payout table indicates a progressive amount is to be paid) and/or using tokens or chips in the dealer chip tray (when a progressive/fixed amount wager was made and the progressive/fixed amount payout table indicates a fixed amount is to be paid and/or when a "Match The Dealer" wager was made and its associated payout table is used to determine the amount).

As stated in block 890 of FIG. 6B, in the case in which a player has two suited kings of spades matches using physical cards (combination of player with two kings of spades and dealer with one king of spades), the player wins 100% of the progressive jackpot, which amount is currently shown on the progressive jackpot display 630. And, the player is eligible to play the next round (e.g., identified as "Go For The Millions"—GFTM) involving electronic cards, whereby the player has the opportunity to win a substantial amount without any further wager.

More specifically, in connection with GFTM play, as further indicated by block 890, an authorized casino employee (e.g., dealer and/or pit boss) enters a first code using the panel 610, such as its touch screen, so that the first code is received by the table control 1-130-1 at table 1-110-1. Per block 900, the table control 1-130-1 then sends an input to its associated casino control 140-1, which instructs the casino control 140-1 to reset the amount in each of its associated progressive jackpot displays 630. If the casino control 140-1 is not the master casino control, the casino control 140-1 can send a signal instructing the master casino control to reset each of the progressive jackpot displays 630 with which it is associated to the next progressive jackpot start amount. The master casino control can provide each of the other casino control(s) 140, with which it is associated, with the new jackpot amount, as noted in block 910. Each casino control 140 can provide each of its associated table controls 130 with the new jackpot amount. Each such table control 130 can control the new progressive jackpot amount to be immediately displayed using each associated progressive jackpot display 630 and/or using an associated or connected video monitor viewable by all players and observers.

Essentially immediately after the first code is input, the panel 610 is also used to enter or input the name of the winning player. His/her name is received by the table control 1-130-1, as conveyed by block 920 of FIG. 6B. The table control 130-1 can signal or notify its associated casino control 140-1 that the named player is to be playing the GFTM round. If the casino control 140-1 is not the master casino control, the casino control 140-1 can provide such information to the casino control 140 that is the master casino control.

According to one embodiment, after the casino control 140 that is the master casino control receives the identity of the named or winning player such master casino control can provide a second code to the panel 610 using the table control 1-130-1. That is, in addition to the panel 610 serving as a device for inputting the first code and for inputting the name of the winning player, it also can be used to output the second code related to associating or correlating information related to winning at least some percentage (e.g. 10% or 100%) of the progressive jackpot. More specifically, the second code is output/displayed using the panel 610 and can be used to correlate information, such as a photo of the named or jackpot winning player, with the jackpot amount that was won. With regard to using the second code, a separate device could be utilized for inputting the second code, along with a photo of the winning player. This separate device can be a tablet computer owned or possessed by the casino. The second code can be input to this tablet computer by an authorized casino employee. The player's photo can also be input to the tablet computer. In one embodiment, the photo is entered by the winning player using the tablet computer, with the photo being taken (e.g. "selfie") using a camera application on the tablet computer. This obtained photo is sent to and ultimately received by the central control 150, such as by using a mail server.

Reference is again made to block 920 related to steps occurring after the player name was communicated by the table control 1-130-1 to the master casino control. In particular, the master casino control can send the player name and the three encrypted random numbers, which it already has since it provided those random numbers to the casino control 140-1, to all other casino controls 140 (if there are any). As indicated in block 930, each casino control 140 can decrypt the three encrypted random numbers, determine which three cards such random numbers represent and algorithmically determine the order in which the three electronic cards are to be displayed, which order can relate to generating desired player excitement. Each casino control 140 can send the player name, together with (in one embodiment) the player's photo having received it from the central control 150, and the three electronic cards in the order in which they are to be displayed to all their associated table controls 130 in that casino 100, such as casino one 100-1. Each table control 130 can control a display, as stated in block 940 of FIG. 6B, of the player name, the player's photo (in one embodiment), as well as the three electronic cards using its associated progressive jackpot display 630 and/or using the associated video monitor provided at each table 110. Consequently, when the player is playing the GFTM round, such play that includes the dealing/providing the electronic cards is displayable in at least substantially real time and can be viewed using all such displays 630 (and/or using all such monitors). Additionally, the player's name and/or photo might be viewable during such GFTM play and the winning amount could be similarly displayed if the player wins the GFTM. That is, the winning amount could be provided on all progressive jackpot displays 630 and/or the associated video monitors for each applicable casino, such as casino one 100-1, as set out in block 950 of FIG. 6C.

Such displays can also be shown using other casino controls 140 and/or the master casino control associated with one or more other casinos 100, where such other casinos 100 are commonly owned, controlled or otherwise are part of a common network of casinos 100. With respect to replacing the three random numbers that were used by the casino control 140-1, it (or the master casino control if the casino control 140-1 is not the master casino control) sends a request to the central control 150 for another three encrypted random numbers. These new random numbers are generated using the central control 150 and sent to either the casino control 140-1, if it is the master casino control, or another casino control 140 that is the master casino control, and with any such master casino control storing the new random numbers for possible use later. At some time prior to such a request, the master casino control can send one of its two spare sets of three random numbers to the casino control 140-1, if the casino control 140-1 is not the master casino control, so that the casino control 140-1 again has three random numbers for possible use. Preferably, these three random numbers are sent by the master casino control about the time that it received the name of the player, who is to play the GFTM round, from the casino control 140-1.

Continued table game play also involves determinations and any payout(s) for each and any player who made a side bet or bonus wager, e.g. a "Match The Dealer" wager (block 960). Any such payout is based on the bonus wager rules, such as the rules for the "Match The Dealer" game. Unlike the progressive/fixed amount wager, any and all bonus wager payouts are made using the tokens in the dealer tray. Before each, if any, bonus wager payout is paid, the dealer removes any non-winning bonus (e.g. "Match The Dealer") wagers. This round of game play with physical cards further continues in accordance with the rules of blackjack or the blackjack variant game, with each of the player(s) and dealer possibly being dealt one or more additional cards. After all cards have been dealt, the dealer determines any and each winning hand associated with the base game wagers made by the players. Payouts are made for such base game winning hands, as noted in block 970. Non-winning base wagers are removed by the dealer. A next round of game play, as indicated by block 980 of FIG. 6C, can start, such as starting with block 760 and continuing with the stages or steps previously described.

The immediately above descriptions have focused on method of play using a single table 1-110-1 having a number of sensor assemblies 200 and a corresponding number of progressive/fixed amount wager areas 250. As disclosed by FIG. 1, the inventive structures and methodologies are scalable to any number of tables 110 so that the progressive jackpot amount can depend on game play at more than one table 1-110-1, including tables 1-110-2 . . . n-110-*n*. Alternatively, the progressive jackpot amount could also depend on play at tables 2-110-1 . . . 2-110-*n* of casino 2 100-2, which gaming tables could be located in a different, but commonly owned casino 100-2, as well as depend on play at tables 1-110-2 . . . 1-110-*n*. Therefore, the amount in the progressive jackpot could be substantial, and the possible winning amount(s) much higher, since the jackpot amount is a function of play at a substantial number of tables 110, all of which are part of the system 20.

Furthermore, GFTM play has been described hereinabove in connection with two kings of spades matches. Alternative embodiments or variants could include: (i) a GFTM round occurring when there is any double suited kings matches (not only kings of spades) so that double suited matches of each of kings of diamonds, hearts and clubs would result in a GFTM round of play; (ii) a GFTM round occurring when there is two suited matches of any face card; or (iii) a GFTM round occurring when there is two suited matches of any face card as well as aces. Additional variants that result in a GFTM round of play could also be devised, for example, based on the desires/instructions of a particular casino or casinos.

As summary and/or outline information related to one or more possible system 20 component functions and communications, the following is also provided:

1. Central control (150)—receives winning information (e.g., amount won, winning player's name) from master casino control 140-*n*).

controls generation of random numbers for use in providing electronic (virtual) cards for sending to one or more master casino controls and maintains list of all random numbers, as well as the one or more master casino controls and casino controls (non-master) they are assigned to.

stores information about every bet (wager amounts and rounds), together with progressive and GFTM payouts, as reported by each master casino control by table and by date.

sends winning information to any other master casino control (not associated with the particular winning information).

sends software updates to each master casino control.

2. Master casino control (140-*n*)—connects to/communicates with the central control (150).

used to control any changes to gaming-related parameters, such as:

a. initial seed amount b. reseed target or amount c. two (2) suited king of spades matches GFTM amount (e.g. $10,000,000)

d. codes to be entered by authorized personnel e. future percentage of bet being made that is to be used to increase the progressive jackpot amount.

stores and relays to central control 150 information about bets (wager amounts and rounds), together with progressive and GFTM payouts by table and date.

receives the winning information from the particular table control 130 associated with the winning player.

sends the winning information to each connected casino control 140 (non-master).

sends the winning information to each connected table control 130 which is not the particular table control.

sends the winning information to the central control 150.

sends software updates to all casino controls 140 (non-master) and each connected table control 130.

relays current progressive jackpot amount to each casino control 140 (non-master) and to each connected table control 130.

sends information about parameters (e.g., bet per hand, progressive amount, etc.) to each casino control 140 (non-master) and each connected table control 130.

3. Casino control 140 (non-master)—connects to/communicates with master casino control 140-*n*.

stores and relays to master casino control 140-*n* information related to each bet, as well each progressive and GFTM payout.

receives the winning information from its associated or connected master casino control 140-*n*.

sends the winning information to each associated or connected table control 130.

relays current GFTM information to each associated or connected table control 130.

relays software updates to each associated or connected table control 130.

relays current progressive jackpot amount to each associated or connected table control 130.

4. Table control 130—connects to/communicates with a casino control 140, which could be a master casino control 140-*n* or a casino control 140 (non-master) and connects to/communicates with its associated progressive jackpot display 630 and/or associated video monitor/screen.

allows for tests and desired configurations to be implemented/used related to components provided with its associated gaming table 110 controls game play, including:

a. senses betting tokens or chips on a particular sensor assembly 200 b. controls on/off for associated light array(s) 640 c. controls entry of codes related to winning information d. provides codes for use by the tablet computer including its camera application to enable proper inputting of winning information into the tablet computer e. sends information related to bets made to its associated or connected casino control 140 f. receives the winning information from its associated or connected casino control 140 (master or non-master)

g. displays the winning information using the progressive jackpot display 630 and/or associated video monitor/screen and h. relays the current progressive jackpot amount to the associated progressive jackpot display 630 and/or associated video monitor/screen.

The foregoing discussion has been presented to illustrate and describe certain embodiments of the invention. Further, the description is not intended to limit the invention to the form disclosed herein, as the inventive features might be used in online applications based on the disclosed systems and/or methods of operation and/or play. Consequently, further variations and modifications commensurate with the above teachings, within the skill and knowledge of the relevant art, are within the scope of the present invention. The embodiments described hereinabove are further intended to explain the best modes presently known of practicing the invention and to enable others skilled in the art to utilize the same as such, or in other embodiments, and with the various modifications required by their particular application or uses of the invention. It is also intended that the claims be construed to include alternative embodiments to the extent permitted by the prior art.

What is claimed is:

1. An apparatus for use in detecting at least a first token used in playing a casino game, comprising;

a sensor system that includes a sensor assembly that outputs un-modulated light and receives un-modulated returned light when the first token is present, said sensor assembly including a sensor housing that includes a cover and a light path member joined to said cover, said light path member having a geometric shape and extending in a direction away from the first token when the first token is located on said cover, said light path member having said geometric shape being positioned relative to said cover such that at least portions of said un-modulated light passes from said light path member to the first token when the first token is present and in which at least portions of said un-modulated returned light passes from the first token to said light path member when the first token is present;

an input element;

a control that is responsive to said input element and is used in controlling said un-modulated light that is output by said sensor assembly and that is used in controlling an indication of the first token when the first token is present; and a table that supports at least said sensor assembly and is associated with said control and said input element and includes at least a first wager area for receiving the first token.

2. An apparatus of claim 1 wherein said sensor assembly includes an emitter for outputting said un-modulated light and a receiver for receiving said un-modulated returned light, said un-modulated light being in an infrared frequency range and said receiver having a light blocking filter associated with passing light associated with at least some part of the infrared frequency range, and in which said light blocking filter is defined as matching with 940 nm wavelength emitters and having a range of spectral bandwidth of 900-950 nms wavelength.

3. An apparatus of claim 1 wherein said sensor system includes a cable having a number of signal wires in communication with sensor housing circuitry and multiplex circuitry, which is electrically connected to said control, and said table comprises a number of layers including a foam layer having at least one recess in which folded portions of said cable are positioned in said at least one recess.

4. An apparatus of claim 1 wherein said geometric shape of said light path member is conical-shaped with a tip that is located more inwardly of said sensor housing than other portions of said conical-shaped light path member.

* * * * *